United States Patent [19]

Collins

[11] Patent Number: 4,557,853

[45] Date of Patent: Dec. 10, 1985

[54] SKIN CLEANSING COMPOSITIONS CONTAINING ALKALINE EARTH METAL CARBONATES AS SKIN FEEL AGENTS

[75] Inventor: Royal D. Collins, Bethel, Ohio

[73] Assignee: The Procter & Gamble Company, Cincinnati, Ohio

[21] Appl. No.: 643,913

[22] Filed: Aug. 24, 1984

[51] Int. Cl.[4] ..... C11D 13/14; C11D 17/00

[52] U.S. Cl. ..... 252/128; 252/112; 252/113; 252/115; 252/116; 252/119; 252/123; 252/124; 252/131; 252/133; 252/134; 252/140; 252/174.14; 252/174.17; 252/174.25; 252/DIG. 5; 252/DIG. 16

[58] Field of Search ..... 252/112, 113, 115, 116, 252/119, 122, 123, 124, 128, 131, 133, 134, 140, 174.14, 174.17, 174.25, DIG. 5, DIG. 14, DIG. 16

[56] References Cited

U.S. PATENT DOCUMENTS

| | | | |
|---|---|---|---|
| 92,651 | 7/1869 | Sanger | 252/119 |
| 1,492,507 | 4/1924 | Bradshaw | 252/116 |
| 1,659,980 | 2/1928 | Lindy | 252/129 |
| 3,070,547 | 12/1964 | Chaffee | 252/121 |
| 3,248,333 | 4/1966 | O'Roark | 252/144 |
| 3,408,299 | 10/1968 | Henry | 252/129 |
| 3,576,749 | 4/1971 | Megson et al. | 252/134 |
| 4,051,056 | 9/1977 | Hartman | 252/99 |
| 4,302,347 | 11/1981 | Straw et al. | 252/116 |
| 4,457,856 | 7/1984 | Mitchell et al. | 252/166 |

FOREIGN PATENT DOCUMENTS 19257 of 1896 United Kingdom .

*Primary Examiner*—Paul Lieberman
*Assistant Examiner*—Hoa Van Le
*Attorney, Agent, or Firm*—Richard C. Witte; Ronald L. Hemingway

[57] ABSTRACT

Skin cleansing compositions comprising a soap or synthetic detergent and finely divided alkaline earth metal carbonates. The alkaline earth metal carbonates produce frictional forces on the wet rinsed skin which users associate with a feeling of cleanliness.

9 Claims, No Drawings

SKIN CLEANSING COMPOSITIONS CONTAINING ALKALINE EARTH METAL CARBONATES AS SKIN FEEL AGENTS

FIELD OF THE INVENTION

This invention pertains to soap compositions for personal washing, which contain water-insoluble inorganic particulate materials to provide a special skin feel effect.

BACKGROUND ART

When compositions made with soap (e.g., sodium salts of tallow and/or coconut fatty acids) are used for personal cleansing, the wet skin is left with a characteristic feel imparted by residual soap film. The feel is manifested as friction or drag when the wet skin is rubbed with other wet skin, such as by rubbing the fingers of one hand over the back of the other hand after washing and rinsing the hands. Consumers generally associate this "draggy" sensation with a clean feel and describe it as a "squeaky" or "squeaky clean" feel. Personal cleansing products made with synthetic detergents, on the other hand, tend to leave the skin with a slick, slippery feel which is often described by consumers as a "smoothness." Some consumers associate this "smoothness" as a different kind of clean feeling than associated with that delivered by a soap matrix. Simply stated, some consumers associate the "draggy" feel with clean, while others associate the "slick" feel with clean.

In order to appeal to consumers who associate a "draggy" sensation with a "squeaky clean" skin feel, it is desirable, and an object of the present invention, to provide soap-based skin cleansing products which impart an increased "draggy" feel to the wet skin after washing. It is a further object of the invention to provide synthetic-based skin cleansing products which impart the type of "draggy" feel to the skin which users have typically obtained only from soap-based products.

These objects are achieved by incorporating certain insoluble particulate materials into soap and synthetic skin cleansing compositions.

The inclusion of water-insoluble particulate substances in bar soap compositions to achieve an abrasive effect and thereby assist in the removal of difficult soils and stains from skin and other surfaces is known in the art. See, for example, U.S. Pat. Nos. 1,659,980, Lindy, issued Feb. 21, 1928, and 3,408,299, Henry, issued Oct. 29, 1968.

SUMMARY OF THE INVENTION

The present invention is directed to skin cleansing compositions which provide a "draggy" (i.e., frictional) feel to the wet skin after rinsing, the said compositions comprising a soap and/or synthetic detergent and a finely divided alkaline earth metal carbonate having a particle size of less than about 150 microns.

DETAILED DESCRIPTION OF THE INVENTION

In accordance with the present invention it has been found that the type of friction or drag effect, typically referred to by consumers as "squeaky clean", and which is characteristic of that produced by soap-based products on wet skin after rinsing, can be achieved with synthetic based skin cleansing products by incorporating therein finely divided alkaline earth metal carbonates. Moreover, it has been found that the degree of this feel produced by soap-based products can be increased by incorporating alkaline earth metal carbonates into soap-based products.

The compositions of the invention comprise from about 10% to about 85% of a surface-active agent (surfactant) selected from soaps and synthetic detergents and mixtures thereof, and from about 0.15% to about 10% of one or more alkaline earth metal carbonates having a particle size of less than about 150 microns, the weight ratio of surfactant to alkaline earth metal carbonate in said compositions being from about 8:1 to about 50:1, preferably from about 16:1 to about 40:1, most preferably from about 20:1 to about 40:1.

All percentages and ratios herein are "by weight" unless specified otherwise. Particle size refers to the measurement of the particle in its longest cross-sectional dimension.

The Surfactant Component

The surfactant component of the compositions of the present invention can be selected from synthetic detergents, soaps and mixtures thereof.

The synthetic detergents can be selected from the anionic, nonionic, amphoteric and ampholytic types. Such detergents are well known to those skilled in the detergency art.

The most common type of anionic synthetic detergents can be broadly described as the water-soluble salts, particularly the alkali metal salts, of organic sulfuric reaction products having in the molecular structure an alkyl radical containing from about 8 to about 22 carbon atoms and a radical selected from the group consisting of sulfonic acid and sulfuric acid ester radicals. Important examples of these synthetic detergents are the sodium, ammonium or potassium alkyl sulfates, especially those obtained by sulfating the higher alcohols produced by reducing the glycerides of tallow or coconut oil; sodium or potassium alkyl benzene sulfonates, in which the alkyl group contains from about 9 to about 15 carbon atoms, especially those of the types described in U.S. Pat. Nos. 2,220,099 and 2,477,383, incorporated herein by reference; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about three moles of ethylene oxide; sodium or potassium salts of alkyl phenol ethylene oxide ether sulfates with about four units of ethylene oxide per molecule and in which the alkyl radicals contain about 9 carbon atoms; the reaction product of fatty acids esterified with isethionic acid and neutralized with sodium hydroxide where, for example, the fatty acids are derived from coconut oil; sodium or potassium salts of fatty acid amide of a methyl taurine in which the fatty acids, for example, are derived from coconut oil; and others known in the art, a number being specifically set forth in U.S. Pat. Nos. 2,486,921, 2,486,922 and 2,396,278, incorporated herein by reference.

Nonionic synthetic detergents comprise a class of compounds which may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name of "Pluronic." These compounds are formed by condensing ethylene oxide with an hydrophobic base formed by the condensation of propylene oxide with propylene glycol. The hydrophobic portion of the molecule which, of course, exhibits water-insolubility has a molecular weight of from about 1500 to 1800. The addition of polyoxyethylene radicals to this hydrophobic portion tends to increase the water-solubility of the molecule as a whole and the liquid character of the products is retained up to the point where polyoxyethylene content is about 50% of the total weight of the condensation product.

Other suitable nonionic synthetic detergents include:

(i) The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane, for example.

(ii) Those derived from the condensation of ethylene oxide with the product resulting from the reaction of propylene oxide and ethylene diamine—products which may be varied in composition depending upon the balance between the hydrophobic and hydrophilic elements which is desired. Examples are compounds containing from about 40% to about 80% polyoxyethylene by weight and having a molecular weight of from about 5000 to about 11,000 resulting from the reaction of ethylene oxide groups with a hydrophobic base constituted of the reaction product of ethylene diamine and excess propylene oxide, said base having a molecular weight of the order of 2500 to 3000, are satisfactory.

(iii) The condensation product of aliphatic alcohols having from 8 to 18 carbon atoms, in either straight chain or branched chain configuration, with ethylene oxide, e.g., a coconut alcohol ethylene oxide condensate having from 10 to 30 moles of ethylene oxide per mole of coconut alcohol, the coconut alcohol fraction having from 10 to 14 carbon atoms.

(iv) Trialkyl amine oxides and trialkyl phosphine oxides wherein one alkyl group ranges from 10 to 18 carbon atoms and two alkyl groups range from 1 to 3 carbon atoms; the alkyl groups can contain hydroxy substituents; specific examples are dodecyl di(2-hydroxyethyl)amine oxide and tetradecyl dimethyl phosphine oxide.

Zwitterionic detergents comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Suitable zwitterionic detergent compounds have the formula

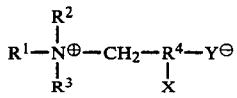

wherein $R^1$ is an alkyl radical containing from about 8 to about 22 carbon atoms, $R^2$ and $R^3$ contain from 1 to about 3 carbon atoms, $R^4$ is an alkylene chain containing from 1 to about 3 carbon atoms, X is selected from the group consisting of hydrogen and a hydroxyl radical, Y is selected from the group consisting of carboxyl and sulfonyl radicals and wherein the sum of the $R^1$, $R^2$ and $R^3$ radicals is from about 14 to about 24 carbon atoms.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol," and described in U.S. Pat. No. 2,528,378, said patents being incorporated herein by reference.

Additional synthetic detergents and listings of their commercial sources can be found in *McCutcheon's Detergents and Emulsifiers*, North American Ed. 1980, incorporated herein by reference.

Soaps which can be used as the surfactant in the present compositions are alkali metal (e.g., sodium or potassium) soaps of fatty acids containing from about 8 to about 24, preferably from about 10 to 20 carbon atoms. The fatty acids used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process).

Alkali metal soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures which typically have an approximate carbon chain length distribution of 2.5% $C_{14}$, 29% $C_{16}$, 23% $C_{18}$, 2% palmitoleic, 41.5% oleic and 3% linoleic (the first three fatty acids listed are saturated). Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties.

When the term "coconut oil" is used herein it refers to fatty acid mixtures which typically have an approximate carbon chain length distribution of about 8% $C_8$, 7% $C_{10}$, 48% $C_{12}$, 17% $C_{14}$, 9% $C_{16}$, 2% $C_{18}$, 7% oleic, and 2% linoleic (the first six fatty acids listed being saturated). Other sources having similar carbon chain length distribution such as palm kernel oil and babassu oil are included with the term coconut oil.

The Alkaline Earth Metal Carbonate Component

The alkaline earth metal carbonates used in the compositions herein (i.e., carbonates of the Group II-A metals of the Periodic Table of Elements) are highly insoluble in water.

The most common alkaline earth metal carbonates are those of calcium and magnesium, and these are the ones preferred for use in the present invention. They occur naturally as the minerals calcite and magnesite, and are also made synthetically by precipitation from solutions of soluble salts of calcium or magnesium (e.g., the sulfates or chlorides) and soluble carbonate salts (e.g., $Na_2CO_3$).

The alkaline earth metal carbonates used in the soap compositions herein should have a very small particle size, i.e., less than about 150 microns. Preferably, the size of the particles is between about 50 and about 0.03 microns, and most preferably, the size is between about 20 and 0.03 microns. The Number 100 Tyler Standard Screen corresponds to about 150 microns. A Number 325 Screen corresponds to about 45 microns.

Optional Materials

The compositions of the invention can optionally contain materials which are conventionally used in skin cleansing compositions.

Antibacterial agents can be included in the present composition at levels of from about 0.5% to about 4%. A typical antibacterial agent which is suitable for use herein is 3,4,4'trichlorocarbanilide, also known as Triclorocarban, and sold by Monsanto Company.

Nonionic emollients can be included as skin conditioning agents in the compositions of the present invention at levels up to about 10%. Such materials include, for example, mineral oils, paraffin wax having a melting point of from about 100° F. to about 170° F., fatty sorbitan esters (see U.S. Pat. No. 3,988,255, Seiden, issued Oct. 26, 1976, incorporated by reference herein), lanolin and lanolin derivatives, esters such as isopropyl myristate and triglycerides such as coconut oil or hydrogenated tallow.

Free fatty acid such as coconut oil fatty acid can be added to the compositions herein at levels up to about 10% to improve the volume and quality (creaminess) of the lather produced by the compositions.

Perfumes, dyes and pigments can also be incorporated into compositions of the invention at levels up to about 5%. Perfumes are preferably used at levels of from about 0.5% to 3% and dyes and pigments are preferably used at levels of from about 0.001% to about 0.5%.

A preferred optional component in the compositions herein is particulate starch. This material causes the lather produced by the composition to be more dense; an effect which is preferred by some users. The starch should have a particle size of less than about 150 microns, preferably between about 0.03 and 50 microns. Examples of suitable starches are corn, potato, rice and tapioca starches. A preferred starch is a chemically treated starch sold under the name DryFlo® by National Starch Company. The amount of starch used in the compositions herein should be from about 0.5 to about 3 (preferably from about 1 to 2.5) times the amount of alkaline earth metal carbonate in the composition.

Composition Preparation

The compositions of the present invention are preferably prepared in the form of toilet bars, but can also be prepared in other forms such as liquids or pastes. The toilet bar is the most preferred form since it is the form of cleansing composition most commonly used to wash the skin.

Toilet bars generally comprise from about 50% to about 90% surfactant (soap or synthetic). Moisture is generally present at levels of from about 5% to about 20%. Liquids generally comprise from about 10% to about 30% surfactant and about 60% to about 90% water. Pastes generally comprise from about 20% to about 60% surfactant and from 30% to 50% water. Pastes and liquids will also generally contain organic thickening agents such as natural gums and polymers. Such agents are particularly desirable in liquid compositions of the invention since they aid in suspending the insoluble alkaline earth metal carbonate particles in the liquid matrix.

Examples of soap-based toilet bar compositions which can be used in preparing compositions of the present invention can be found in U.S. Pat. No. 3,576,749, Megson et al., issued Apr. 27, 1971. Examples of synthetic-based toilet bars which can be used in preparing compositions of the invention can be found in U.S. Pat. No. 2,987,484, Lundberg et al., issued June 6, 1961. Examples of soap/synthetic-based toilet bars which can be used in preparing compositions of the invention can be found in U.S. Pat. No. 3,070,547, Chaffee, issued Dec. 25, 1962 and U.S. Pat. No. 3,376,229, Haas et al., issued Apr. 2, 1968. Examples of soap-based liquid cleansing compositions which can be used in preparing liquid compositions of the invention can be found in U.S. Pat. No. 4,310,433, Stiros, issued Jan. 12, 1982. Examples of synthetic-based liquid cleansing compositions which can be used in preparing compositions of the invention can be found in U.S. Pat. No. 4,338,211, Stiros, issued June 6, 1982. These composition patents are incorporated herein by reference. Paste compositions can be made by appropriate reduction in the levels of water in the compositions of U.S. Pat. Nos. 4,310,433 and 4,338,211.

Particularly preferred compositions of the invention are soap based toilet bars which comprise from about 70% to about 85% soap, from about 1.5% to about 10% (preferably about 2% to about 5%) alkaline earth metal carbonate and, optionally, from about 3% to about 10% free fatty acid, preferably coconut oil fatty acid.

The alkaline earth metal carbonates can be added to toilet bar compositions in the same manner as other additives such as pigments, antibacterials, etc. This is usually done at the amalgamation step, i.e., the mixing step, which occurs prior to milling and plodding the composition. The alkaline earth metal carbonates can be incorporated into liquids and pastes by using the same mixing techniques employed for incorporating other additives such as pigments and opacifiers into such compositions.

Composition Use

The compositions of the invention are used in the conventional manner, i.e., they are applied to the skin and the skin is rinsed with water. In the case of liquids and pastes the composition can be applied "as is" to the skin. In the case of toilet bars, a solution or dispersion of the composition is formed prior to application by wetting the surface of the bar or rubbing the bar onto a wet washcloth. The wet bar or washcloth, which contains a portion of the composition, diluted with water, is then rubbed against the skin. The characteristic skin feel produced by compositions of the invention, which is variously described as "draggy" or "squeaky clean" is apparent on the wet skin just after rinsing the composition from the skin.

The invention will be illustrated by the following examples.

EXAMPLES

Two compositions of the invention (Compositions 2 and 3) containing 2% calcium carbonate and magnesium carbonate, respectively, and comparable compositions (4 through 7) containing 2% of various other insoluble particulate materials were prepared in the form of soap-based toilet bars. A placebo control composition (Composition 1) containing no particulate additive was also prepared. The compositions are shown in Table 1.

TABLE 1

| | 1 | 2 | 3 | 4 | 5 | 6 | 7 |
|---|---|---|---|---|---|---|---|
| Composition | | | | | | | |
| Na tallow soap | 47.85 | 46.65 | 46.65 | 46.65 | 46.65 | 46.65 | 46.65 |
| Na coconut soap | 31.90 | 31.10 | 31.10 | 31.10 | 31.10 | 31.10 | 31.10 |
| Moisture | 9.75 | 9.75 | 9.75 | 9.75 | 9.75 | 9.75 | 9.75 |
| Coconut fatty acid | 7.00 | 7.00 | 7.00 | 7.00 | 7.00 | 7.00 | 7.00 |
| Perfume | 1.50 | 1.50 | 1.50 | 1.50 | 1.50 | 1.50 | 1.50 |
| NaCl | 1.10 | 1.10 | 1.10 | 1.10 | 1.10 | 1.10 | 1.10 |
| $TiO_2$ | 0.25 | 0.25 | 0.25 | 0.25 | 0.25 | 0.25 | 0.25 |
| Trichlorocarban | 0.55 | 0.55 | 0.55 | 0.55 | 0.55 | 0.55 | 0.55 |
| Particulate Additive: | | | | | | | |
| $CaCO_3$ | — | 2.00 | — | — | — | — | — |
| $MgCO_3$ | — | — | 2.00 | — | — | — | — |
| DryFlo$^R$ starch | — | — | — | 2.00 | — | — | — |
| Talc | — | — | — | — | 2.00 | — | — |
| Clay | — | — | — | — | — | 2.00 | — |
| Precipitated silica | — | — | — | — | — | — | 2.00 |
| Particle size of additive: (% thru 325 mesh) | | 100% | 99.5% | 98% | 99% | 99.98% | 100% |

These toilet bar compositions were tested in a skin washing test among consumers. Each consumer evaluated a pair of bars, one bar being Composition 1 (the placebo control) and the other being one of Compositions 2–7, which contained 2% of a particulate additive. Each pair of compositions was evaluated by a panel of 50 consumers. A different panel of consumers was used for each pair.

In the test procedure, each panelist was presented with a pair of bars and was asked to perform the following task:

1. Wash one forearm three times with one product, each wash to be performed in the following manner:
   (a) wet the forearm;
   (b) wet the bar and rub on the forearm for 10 seconds;
   (c) using the opposite hand, lather the forearm for 15 seconds;
   (d) rinse the forearm with running water while firmly rubbing the forearm with the opposite hand.

The panelist was then asked to wash the other forearm with the second product in the same way. Following the rinsing of the second product, and while both arms were still wet, the panelist was told to feel each forearm with the opposite hand and state which product was preferred for skin feel. The panelist was then asked to state what was liked about the skin feel produced by the preferred product.

The order in which the products was presented to the panelists was balanced so that in a given panel of 50 persons, each product was used first by half the panel.

The results of this test are shown in Table 2.

TABLE 2

| | Preference for Skin Feel | | Reasons for Skin Feel Preference: "Squeaky Clean" | | Reasons for Skin Feel Preference: Smooth | |
|---|---|---|---|---|---|---|
| Composition | Test Prod. | Control | Test Prod. | Control | Test Prod. | Control |
| 1 (Control) | 22 | 28 | 3 | 2 | 12 | 7 |
| 2 (2% $CaCO_3$) | 26 | 24 | 14 | 8 | 13 | 8 |
| 3 (2% $MgCO_3$) | 30 | 20 | 13 | 7 | 18 | 10 |
| 4 (2% starch) | 26 | 24 | 5 | 2 | 9 | 12 |
| 5 (2% talc) | 22 | 28 | 6 | 5 | 8 | 14 |
| 6 (2% clay) | 26 | 24 | 7 | 6 | 15 | 7 |
| 7 (2% silica) | 18 | 32 | 4 | 9 | 13 | 14 |

These data show that compositions of the invention produced a higher perception of "squeaky clean" skin feel than the other compositions tested.

What is claimed is:

1. A skin cleansing composition, in the form of a toilet bar, comprising:
   A. from about 50% to about 90% of a surfactant or mixture of surfactants selected from the group consisting of soap and anionic, nonionic, amphoteric and zwitterionic synthetic detergents; and
   B. from about 1.5% to about 10% of a particulate alkaline earth metal carbonate having a particle size of from 0.03 to about 50 microns;

the weight ratio of (A) to (B) in said composition being from about 16:1 to about 40:1.

2. The composition of claim 1 wherein the surfactant is soap, and the alkaline earth metal carbonate is selected from the group consisting of calcium carbonate and magnesium carbonate.

3. The composition of claim 2 additionally containing 5% to 20% moisture.

4. The composition of claim 3 wherein the amount of soap is from about 70% to about 85% and wherein the amount of alkaline earth metal carbonate is from about 2% to about 5%.

5. The composition of claim 4 additionally containing from about 3% to about 10% free fatty acid.

6. The composition of claim 1 wherein the surfactant is a synthetic detergent selected from the group consisting of anionic, nonionic, amphoteric and zwitterionic detergents or a mixture of soap and synthetic detergent, and wherein the alkaline earth metal carbonate is selected from the group consisting of calcium carbonate and magnesium carbonate.

7. The composition of claim 6 additionally containing 5% to 20% moisture.

8. The composition of claim 7 wherein the amount of alkaline earth metal carbonate is from about 2% to about 5%.

9. A composition of any of the preceding claims additionally containing particulate starch having a particle size of from about 0.03 to about 150 microns, the said starch being present in the composition in an amount which is from about 0.5 to about 3 times the amount of alkaline earth metal carbonate.

* * * * *